United States Patent [19]

Hummel

[11] Patent Number: 4,480,174

[45] Date of Patent: Oct. 30, 1984

[54] THERMOSTATICALLY CONTROLLED ELECTRIC COMPRESSOR SUMP HEATER HAVING SELF-CONTAINED THERMOSTAT

[75] Inventor: Matt N. Hummel, Glenview, Ill.

[73] Assignee: Acra Electric Corporation, Schiller Park, Ill.

[21] Appl. No.: 397,586

[22] Filed: Jul. 12, 1982

Related U.S. Application Data

[63] Continuation-in-part of Ser. No. 301,144, Sep. 11, 1981, abandoned.

[51] Int. Cl.[3] ..... H05B 1/02; H05B 3/82

[52] U.S. Cl. ..... 219/331; 219/205; 219/335; 219/510; 219/523; 219/531; 219/534; 219/544; 338/243

[58] Field of Search ..... 219/331, 328, 335, 336, 219/337, 316, 322, 510-513, 544, 523, 205, 208, 201, 531, 534; 338/238-243

[56] References Cited

U.S. PATENT DOCUMENTS

| | | | |
|---|---|---|---|
| 2,784,292 | 3/1957 | Haloski | 219/523 X |
| 3,371,192 | 2/1968 | Rosenel | 219/523 |
| 3,399,295 | 8/1968 | Chaustowich | 219/336 X |
| 3,439,150 | 4/1969 | Wells et al. | 219/523 |
| 3,515,851 | 6/1970 | D'Elia et al. | 219/523 |
| 3,767,898 | 10/1973 | Wells et al. | 219/523 X |
| 3,940,591 | 7/1974 | Ting | 219/544 |
| 3,947,656 | 3/1976 | Lodi | 219/331 X |
| 3,970,816 | 7/1976 | Hosokawa et al. | 219/205 |
| 4,091,267 | 5/1978 | Grant | 219/544 |
| 4,124,793 | 11/1978 | Colman | 219/523 |
| 4,125,761 | 11/1978 | Churchill | 219/544 |
| 4,147,927 | 4/1979 | Pirotte | 219/544 X |
| 4,156,128 | 5/1979 | Craven | 219/523 |
| 4,223,208 | 9/1980 | Kleinschmidt et al. | 219/523 X |
| 4,349,727 | 9/1982 | Churchill | 219/544 |

FOREIGN PATENT DOCUMENTS

| | | | |
|---|---|---|---|
| 524629 | 8/1940 | United Kingdom | 219/331 |
| 648230 | 1/1951 | United Kingdom | 219/335 |

*Primary Examiner*—A. Bartis

*Attorney, Agent, or Firm*—Wood, Dalton, Phillips, Mason & Rowe

[57] ABSTRACT

An electric heater for heating oil contained in the sump well of a compressor includes a thermally conductive shell having first and second opposed inner surfaces. A ceramic core having a D-shaped cross-section throughout is positioned in the shell and is provided with longitudinal channels which are disposed substantially the same distance from the outer curved surface of core. An electric resistance heating element is disposed in the channels and is energizable by a source of power for developing heat under the control of a thermostat disposed in the shell. A resilient pad of ceramic fiberglass material having low thermal conductivity is disposed between the flat surface of the core and the thermostat and urges the curved surface of the core and the thermostat into contact with the opposed inner surfaces of the shell while substantially blocking heat transfer therethrough from the heating element to the thermostat.

5 Claims, 6 Drawing Figures

FIG. 1
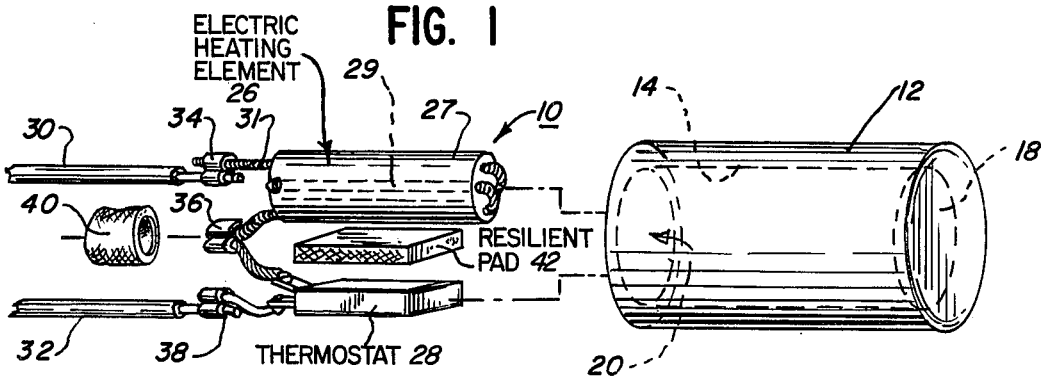
FIG. 2
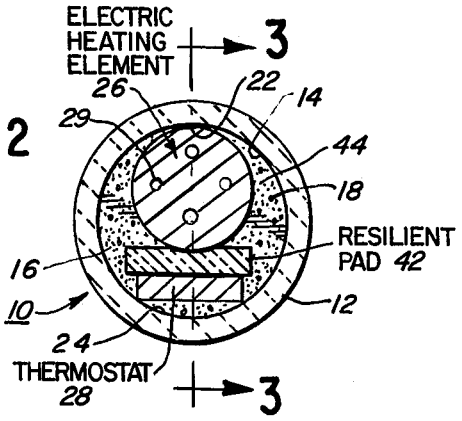
FIG. 4
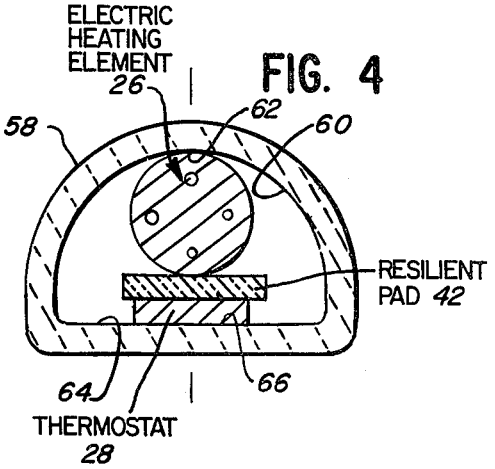
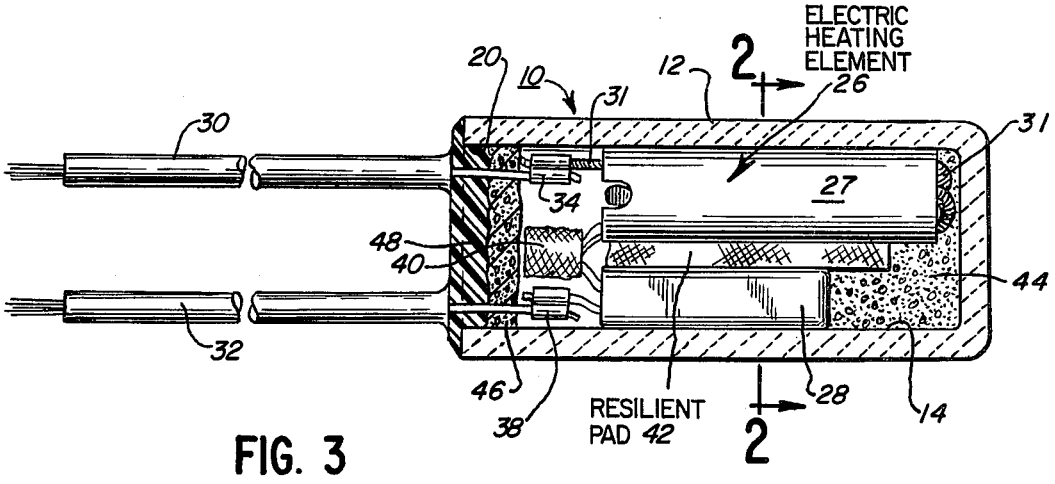
FIG. 3

THERMOSTATICALLY CONTROLLED ELECTRIC COMPRESSOR SUMP HEATER HAVING SELF-CONTAINED THERMOSTAT

DESCRIPTION

This application is a continuation-in-part of U.S. application Ser. No. 301,144, filed Sept. 11, 1981, now abandoned.

BACKGROUND OF THE INVENTION

This invention relates generally to resistance heaters, and more particularly to thermostatically controlled resistance heaters for use in the sump well of a compressor.

Prior types of resistance heaters have generally included a thermally conductive outer sheath having one or more compartments within which is located an electrical resistance heating element and a thermostat for controlling the energization of the heating element. The heating element is spaced away from the sides of the sheath and a thermally conductive but electrically insulative fill material is located in the space between the sheath and the heating element.

In these prior types of heaters, the thermostat is mounted within the sheath such that heat conduction takes place from the heater to the thermostat along a path which is enclosed within but does not pass through the sheath. A consequence of this type of arrangement is that the thermostat is exposed to higher temperatures than the object or material to be heated, and hence the thermostat may de-energize the heater before the material to be heated reaches the desired temperature.

Moreover, the spacing of the heating element from the outer sheath decreases the heating efficiency of the heater due to the less than perfect thermal conductivity of the intervening fill material.

Other types of resistance heaters utilize circular cylindrical cores having a plurality of channels through which a resistance heater is wound. The channels, however, are not located at equal distances from the outer sheath, and hence the heat developed by the separate portions or legs of the resistance heater within the channels tends to accumulate within the core due to the differing path lengths of heat conduction from the legs. It has been found that this build-up of heat causes premature switching of the thermostat, resulting in short cycling of the resistance heater.

SUMMARY OF THE INVENTION

In accordance with the present invention, a heater, for example, for use in the sump well of a compressor includes a thermally conductive outer shell which encloses an electrical heating element and a thermostat which are separated by a resilient fiber pad such that the thermostat and heating element are urged outwardly into contact with the inner surface of the outer shell.

The fiber pad has a low thermal conductivity to block the transfer of heat therethrough from the resistance heating element to the thermostat. Consequently, the thermostat senses only the heat conducted through the outer shell and through the material to be heated, thereby insuring a proper cutoff point for the energization of the heating element. Moreover, since the heating element directly contacts the outer shell, heat-transfer characteristics, and hence efficiency, are improved.

In an alternative embodiment of the invention, a ceramic core of D-shape in cross-section is utilized having channels, all of which are disposed at the same approximate distance from adjacent portions of the outer sheath, with the electrical heating element being wound within these channels. The paths of heat conduction from the legs of the resistance heater are approximately of equal lengths, in turn resulting in a reduction of heat build-up within the core. It has been found that this configuration minimizes short cycling of the heating element.

BRIEF DESCRIPTION OF THE DRAWINGS

FIG. 1 is an exploded perspective view of the heater of the present invention;

FIG. 2 is a sectional view taken along line 2—2 of FIG. 3;

FIG. 3 is an elevational view, partly in section, taken along line 3—3 of FIG. 2;

FIG. 4 is a sectional view, similar to FIG. 2, of a further embodiment of the present invention;

DESCRIPTION OF THE PREFERRED EMBODIMENT

Figure 5:
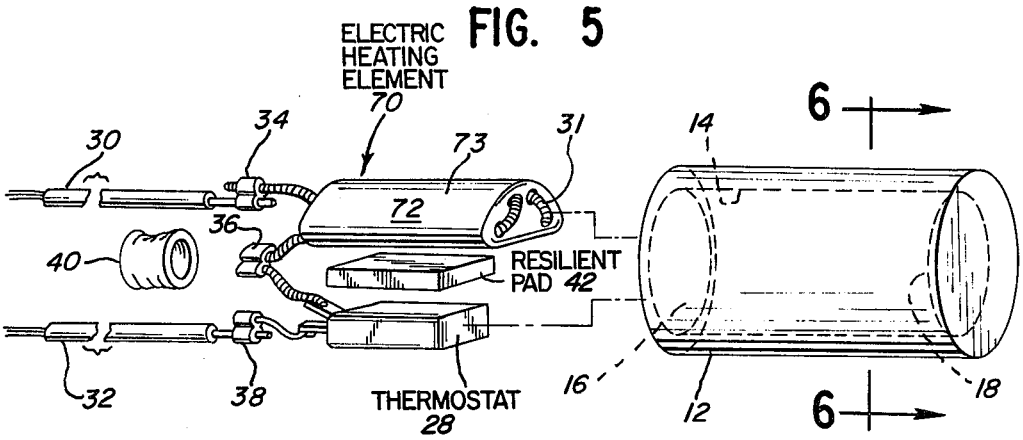
FIG. 5 is an exploded perspective view similar to FIG. 1 of an alternative type of ceramic core for use with the present invention.

Referring now to FIG. 1, there is illustrated a first embodiment of a heater 10 of the present invention.

For example, the heater 10 may be inserted into a metal well of a hermetic compressor (not shown) so as to deliver heat to the crankcase area thereof to vaporize any liquid refrigerant which has migrated to the crankcase area.

Of course, the heater 10 may be used in other applications which require the controlled application of heat as will be obvious to one skilled in the art.

The heater 10 includes a cylindrical outer shell 12 which, in the first embodiment, is circular in cross-section. The outer shell 12 includes an inner surface 14, seen in FIG. 2, which surrounds an inner recess 16. The inner recess 16 terminates at a back wall 18 and communicates with the exterior of the outer shell 12 through an opening 20 located at the end of the shell 12 opposite the back wall 18.

In the first embodiment of the invention, the inner surface 14 includes first and second opposed surfaces 22,24 both of which are semi-circular in cross-section.

The outer shell may be made of ceramic having a high thermal conductivity to rapidly transmit heat to the surrounding environment. The outer shell 12 may be approximately $\frac{3}{4}$ inch long, have a $\frac{3}{4}$ inch outer diameter and a 9/16 inch inner diameter.

An electrical resistance heating element 26 is connected in series with a thermostat 28 between a pair of leads 30,32 which are in turn coupled to a source of electrical power. The heating element 26 and the thermostat 28 are connected together and to the leads 30,32 by means of three connectors 34,36,38, and a fiberglass sleeve 40 is secured over the connector 36 to insulate it from the leads 30,32.

The heating element 26 includes a cylindrical ceramic core 27 having a series of channels 29 through which extends a resistive heater wire 31.

The heater wire 31 may consist of a stranded core around which is wound a resistor. For example, the stranded core may be made of fiberglass or may be made of a heat resisting fiber manufactured by E. I. Du Pont de Nemours & Co., Inc. under the trademark "NOMEX".

Referring also to FIG. 3, a resilient pad 42 is disposed between the heating element 26 and the thermostat 28 and these components 26,28,42 are then inserted into the outer shell 12 through the opening 20. The resilient pad 42 urges the heating element 26 upwardly into contact with the first opposed surface 22 of the inner surface 14, and urges the thermostat 28 downwardly into contact with the second opposed surface 24 of the inner surface 14.

A granular electrically insulative thermally conductive material 44 is then poured into the outer shell 12 so as to surround the various components of the heater 10. For example, this material 44 may be granular magnesium oxide. A cement barrier 46 is placed in the opening 20 so as to completely seal off the interior of the outer shell 12. A sealant 48 is applied to the outside of the cement barrier 46 so as to completely cover the opening 20 and so as to encapsulate the leads 30,32 as they extend out of the opening 20.

In the preferred embodiment, the cement barrier 46 is a refractory cement which withstands high temperatures and blocks to some degree the heat traveling to the sealant 48. A suitable material for this purpose is Sauereisen No. 30 Cement manufactured by Sauereisen Cements Co. In the preferred embodiment, the cement barrier 46 is on the order of $\frac{1}{8}$ inch thick.

The sealant 48 in the preferred embodiment is an air drying silicone adhesive sealant marketed under the trademark RTV and manufactured by Dow Corning Corp.

The resilient pad 42 must have a thickness and resiliency capable of providing a biasing force on the heating element 26 and the thermostat 28 to maintain them in contact with the inner surface 14 of the outer shell 12. A suitable material is a ceramic fiberglass product manufactured by Carborundum Co. under the trademark "FIBER FRAX".

The resilient pad 42 has a low thermal conductivity so as to substantially block the flow of heat therefrom the heating element 26 to the thermostat 28. Accordingly, the thermostat 28 senses substantially only the temperature of the outer shell 12, which is in contact with the object or material to be heated, such as the lubricant in the sump of a compressor. Consequently, the thermostat 28 senses the temperature not only of the heating element 26 through the outer shell 12 but also the temperature of the oil in the sump which may have been heated by the heat generated by the components of the compressor. Thus, the thermostat 28 allows the heating element 26 to deliver heat only until the oil in the sump is at the proper temperature, regardless of how the oil has been heated at which point the thermostat opens and turns off the heating element 26.

Furthermore, the contacting of the heating element 26 with the wall of the outer shell 12 in turn leads to greater efficiency due to the absence of intervening materials which may interfere with heat transfer to the oil in the sump of the compressor.

Referring also to FIG. 4, a second embodiment of the invention is illustrated which utilizes a shell 58 which is D-shaped in cross-section. The outer shell 58 includes an inner surface 60 consisting of first and second opposed surfaces 62,64. The first opposed surface 62 is U-shaped in cross-section and is disposed adjacent a flat base surface which comprises the second opposed surface 64.

The various components of the heater 10 are assembled in the outer shell 58, with a flat face 66 of the thermostat 28 contacting the opposed surface 64 and with the heating element 26 contacting the first opposed surface 62. As before, the resilient pad 42 causes these elements to firmly contact the inner surface 60 of the outer shell 58 to provide the advantages noted with respect to the first embodiment, as outlined above.

Figure 6:
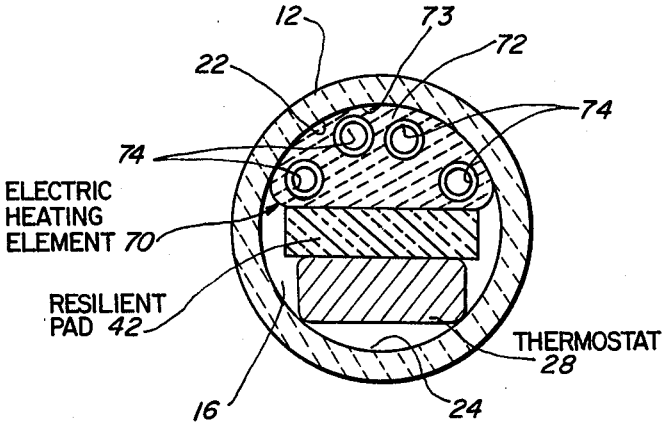
FIG. 6 is a sectional view, similar to FIG. 2, of the embodiment shown in FIG. 5.

Referring now to FIGS. 5 and 6, there is illustrated an alternate configuration for the ceramic core shown in FIGS. 1–4. In FIGS. 5 and 6, those structures which are identical to those shown in FIGS. 1–4 are given like reference numerals.

A heating element 70 includes a ceramic core 72 which is D-shaped in cross-section. The ceramic core 72 includes a series of channels 74 all of which are located the same distance from an outer curved portion 73 of the D-shaped core 72. The resistance heater wire 31 extends through the channels 74 and is connected to the thermostat 28 and to the leads 30,32, as was noted with respect to FIGS. 1–4.

The heating element 70 is assembled within an outer shell, such as the outer shell 12 shown in FIGS. 1 and 2, so that the round or curved portion of the D-shaped ceramic core 72 is in contact with the inner wall 22 of the outer shell 12. Each of the channels 74, and hence each leg of the resistive heater wire 31 is therefore located at approximately the same distance from the inner surface 22 of the outer shell 12.

As was noted with respect to the previous embodiments of the invention, the thermostat 28 and the ceramic fiber pad 42 are also disposed within the outer shell 12 such that the fiber pad 42 urges the thermostat 28 and the heating element 70 into engagement with opposite walls 24,22, respectively of the outer shell 12. The outer shell is then sealed by the cement barrier 46 and the sealant 48 as before noted.

It has been found that by positioning each leg of the resistive heating element at approximately the same distance from the outer shell 12, the heat developed by each leg is dissipated at the same rate as the heat from other legs, and heat build-up within the core is minimized. Therefore, the thermostat 28 senses primarily only the temperature of the surrounding material to be heated and hence proper switching of the thermostat 28 is assured, i.e. short-cycling is substantially reduced or entirely eliminated.

I claim:

1. In a heater having a heating element controlled by a thermostat both of which are disposed within a heat-conductive outer shell, said thermostat sensing the heat output of the heating element and controlling said heat output in response to said sensing, the improvement comprising:

a core having a series of channels in which the heating element is disposed and also having a D-shaped cross-section throughout including a curved surface and a flat surface, all of the channels being disposed approximately the same distance from the curved surface; and a resilient member disposed between the flat surface of the core and the thermostat for urging the curved surface of the core and the thermostat into contact with opposed inner surfaces of the outer shell.

2. The heater of claim 1, wherein the resilient member is a ceramic fiber pad.

3. The heater of claim 1, wherein the outer shell is circular in cross-section and wherein the core and the thermostat contact diametrically opposite portions of the inner surface.

4. The heater of claim 1, wherein the resilient member is disposed between the thermostat and the core and has a low thermal conductivity to substantially block heat transfer therethrough from the heating element to the thermostat.

5. A heater for heating oil contained within a sump well of a compressor, comprising:

a thermally conductive outer shell having first and second opposed inner surfaces;

a ceramic core in the shell having a D-shape in cross-section throughout including a curved outer surface a flat surface, and channels which are all disposed approximately the same distance from the curved outer surface;

an electric resistance heating element disposed in the channels and energizable by a source of power for developing heat;

a thermostat disposed within the shell for controlling the energization of the heating element in response to the developed heat; and a resilient ceramic fiber pad disposed between the flat surface of the core and the thermostat for urging the curved surface of the core and the thermostat into contact with the first and second opposed surfaces, respectively, said pad having a low thermal conductivity to substantially block heat transfer therethrough from the heating element to the thermostat.

* * * * *